US011641914B2

(12) United States Patent
Lisenby et al.

(10) Patent No.: US 11,641,914 B2
(45) Date of Patent: May 9, 2023

(54) TWO-IN-ONE WALKING SUPPORT AND METHODS OF USE

(71) Applicant: Inventive Solutions LLC, Virginia Beach, VA (US)

(72) Inventors: Marion Lisenby, Virginia Beach, VA (US); Lewis Crenshaw, Norfolk, VA (US); Preston Burton, Hampton, VA (US)

(73) Assignee: Inventive Solutions LLC, Virginia Beach, VA (US)

( * ) Notice: Subject to any disclaimer, the term of this patent is extended or adjusted under 35 U.S.C. 154(b) by 0 days.

(21) Appl. No.: 17/743,608

(22) Filed: May 13, 2022

(65) Prior Publication Data

US 2022/0279903 A1 Sep. 8, 2022

Related U.S. Application Data

(63) Continuation of application No. 17/192,346, filed on Mar. 4, 2021, now Pat. No. 11,432,626.

(60) Provisional application No. 62/984,969, filed on Mar. 4, 2020.

(51) Int. Cl.

| | |
|---|---|
| ***A45B 9/02*** | (2006.01) |
| ***A61H 3/00*** | (2006.01) |
| *A45B 9/00* | (2006.01) |

(52) U.S. Cl.

CPC ..... *A45B 9/02* (2013.01); *A61H 3/00* (2013.01); *A45B 2009/005* (2013.01); *A45B 2200/05* (2013.01); *A61H 2201/0107* (2013.01); *A61H 2201/1253* (2013.01); *A61H 2201/1635* (2013.01)

(58) Field of Classification Search

CPC ..... A45B 9/02

See application file for complete search history.

(56) References Cited

U.S. PATENT DOCUMENTS

| | | | |
|---|---|---|---|
| 3,032,048 | A | 5/1962 | Hoffmann |
| 5,295,499 | A | 3/1994 | Stutz |
| D431,900 | S | 10/2000 | San |
| 6,206,019 | B1 | 3/2001 | Horvitz |
| D483,643 | S | 12/2003 | Chien |
| 7,007,704 | B2 | 3/2006 | Luckstead |
| 7,637,273 | B1 | 12/2009 | Lisenby |
| 7,661,713 | B2 | 2/2010 | Panizza |

(Continued)

FOREIGN PATENT DOCUMENTS

| | | | |
|---|---|---|---|
| CN | 303235638 | S | 6/2015 |
| CN | 304084982 | S | 3/2017 |

(Continued)

*Primary Examiner* — Noah Chandler Hawk

(74) *Attorney, Agent, or Firm* — Blank Rome LLP

(57) ABSTRACT

Two-in-one walking supports and methods of using the walking support. The walking supports include first and second shaft portions and a handle assembly that has first and second handles. A latching mechanism is incorporated into the first and second handles and is configured to releasably couple the first and second handles to form the handle assembly and a single walking support configuration with the first and second shaft portions abutting one another and being configured to decouple the first and second handles and separate the first and second shaft portions to form a two-piece walking support configuration.

19 Claims, 15 Drawing Sheets

(56) References Cited

U.S. PATENT DOCUMENTS

| | | | | |
|---|---|---|---|---|
| 7,992,583 | B2 | 8/2011 | Lisenby | |
| D807,146 | S | 11/2018 | Werdowatz | |
| 10,918,177 | B1 | 2/2021 | Peoples | |
| 2004/0065359 | A1* | 4/2004 | Stanec | A45B 9/02 135/72 |
| 2005/0274404 | A1* | 12/2005 | Bergman | A45B 7/00 135/65 |
| 2006/0090782 | A1 | 5/2006 | Bergman | |
| 2007/0267053 | A1* | 11/2007 | Meyers | A45B 9/02 135/65 |
| 2012/0222714 | A1* | 9/2012 | Kuma | A45B 9/02 135/77 |
| 2018/0200137 | A1 | 7/2018 | Bernhardt | |

FOREIGN PATENT DOCUMENTS

| | | | |
|---|---|---|---|
| CN | 304901116 | S | 11/2018 |
| CN | 304977721 | S | 1/2019 |
| CN | 305068389 | S | 3/2019 |
| CN | 305267412 | S | 7/2019 |
| CN | 305294333 | S | 8/2019 |
| CN | 305294334 | S | 8/2019 |
| CN | 305642441 | S | 3/2020 |
| CN | 305642462 | S | 3/2020 |
| DE | 3934065 | A1 | 4/1991 |
| EP | 3064188 | A2 | 9/2016 |
| WO | WO 2005/053595 | A1 | 6/2005 |

* cited by examiner

TWO-IN-ONE WALKING SUPPORT AND METHODS OF USE

CROSS-REFERENCE TO RELATED APPLICATIONS

This application is a continuation of U.S. patent application Ser. No. 17/192,346, filed Mar. 4, 2021, which claims the benefit of priority of U.S. Provisional Application No. 62/984,969 filed on Mar. 4, 2020 and entitled Latching Mechanism for Two-in-One Walking Support and Methods of Use, the content of which are relied upon and incorporated herein by reference in their entireties.

BACKGROUND

Two-in-one walking supports or canes provide the user with the ability to use the walking support as both a cane, i.e. one cane, or as a walker, i.e. two canes. See for example, commonly owned U.S. Pat. No. 7,637,273, the subject matter of which is herein incorporated by reference.

SUMMARY

The present disclosure provides a two-in-one walking support that comprises a first shaft portion that has proximal and distal ends, a second shaft portion that has proximal and distal ends, and a handle assembly. The handle assembly comprises a first handle that is located at the proximal end of the first shaft portion and a second handle that is located at the proximal end of the second shaft portion. A latching mechanism is incorporated into the first and second handles. The latching mechanism is configured to releasably couple the first and second handles to form the handle assembly and a single walking support configuration with the first and second shaft portions abutting one another and being configured to decouple the first and second handles and separate the first and second shaft portions to form a two-piece walking support configuration.

In certain examples of the present disclosure, the latching mechanism includes first and second spring biased pinch keys operatively associated with first and second levers, the first pinch key and the first lever being located in the first handle and the second pinch key and the second lever being located in the second handle; the latching mechanism includes first and second sliders operatively associated with first and second levers wherein the first slider and the first lever are located in the first handle and the second slider and the second lever are located in the second handle; the latching mechanism includes at least one latch arm configured to engage a projecting latch; the at least one latch arm is spring biased; the latching mechanism includes a rotatable collar on one of the first and second handles and a fixed half disc on the other of the first and second handles and the collar is configured to receive the fixed disc; each of the collar and the fixed half disc is located on a stem of one of the first and second handles; and/or the handle assembly includes a thumb groove sized for a user's thumb to assist with actuation of the latching mechanism and separation of the first and second handles.

In other examples, a bottom of each of the first and second handles has a corrugated shaped gripping surface; the gripping surface is configured for two gripping positions; and/or the first and second shaft portions have magnets for abutting the first and second shaft portions together.

The present disclosure may also provide a two-in-one walking support that comprises a first shaft portion, a second shaft portion, and a handle assembly. The handle assembly comprises a first handle that is located at the proximal end of the first shaft portion, and the first handle having a front portion, a rear portion, a top, and a bottom; and a second handle that is located at the proximal end of the second shaft portion, and the second handle having a front portion, a rear portion, a top, and a bottom. A tip is located at the distal ends of the first and second shaft portions, respectively. The rear portion of each handle is wider than the front portion and the bottom of each handle includes a generally corrugated gripping surface configured for a two gripping positions by a user's fingers.

In some examples, the front portion is narrow and a middle portion between the front and rear portions is wider than the front portion; each of the first and second handles has generally concave sides; the walking support further comprises a latching mechanism that is configured to releasably couple the first and second handles to form the handle assembly and a single walking support configuration with the first and second shaft portions abutting one another; the latching mechanism includes at least one latch arm configured to engage a projecting latch; and/or the first and second shaft portions include magnets for abutting the first and second shaft portions together; the latching mechanism includes a rotatable collar on one of the first and second handles and a fixed half disc on the other of the first and second handles and the collar is configured to receive the fixed half disc; and/or the tips include corresponding latches configured to engage one another.

The present disclosure may further provide a method of using a two-in-one walking support, comprising the steps of: holding a two-in-one walking support in a first gripping position by a user, the two-in-one walking support including first and second separable shaft portions, and each of the first and second shaft portions having a handle and a tip; actuating a latching mechanism of the two-in-one walking support to separate the first and second shaft portions of the two-in-one walking support; and after separating the first and second shaft portions, holding the handle of one or both of the first and second portions in a second gripping position of the user.

In certain examples of the method, after separating the first and second shaft portions, the user holds the handles of the first and second shaft portions in the user's left and right hands, respectively, in the second gripping position; the step of actuating the latching mechanism includes the user holding the handles of the first and second shaft portions and then actuating pinch keys or sliders of the first and second handles, respectively; after the step of actuating the pinch keys or sliders of the first and second handles, first and second levers of the latching mechanism are forced upwardly to release the latching mechanism; and/or after releasing the latching mechanism, the handles are separated by the user's thumbs; and/or the step of actuating the latching mechanism includes the user rotating a collar of one of the handles until the collar is disengaged from a fixed half disc of the other of the handles.

The present disclosure may yet further provide a two-in-one walking support that comprises first and second shaft portions and a handle assembly that comprises a first handle that is located at a most proximal end of the first shaft portion, a second handle that is located at a most proximal end of the second shaft portion, and a latching mechanism incorporated into the first and second handles. The latching mechanism can be configured to releasably couple the first and second handles to form the handle assembly and a single walking support configuration with the first and second shaft portions abutting one another and can be configured to decouple the first and second handles and separate the first and second shaft portions to form a two-piece walking support configuration. The latching mechanism includes a plurality of cooperating first and second latches, the first handle includes at least one of the first latches and at least one of the second latches, and the second handle includes at least one of the first latches and at least one of the second latches.

In certain examples, the first latches are spring biased pinch keys or sliders and the second latches are levers; the first latches are spring biased latch arms and the second latches are projecting latches; one of the first latches is a rotatable collar on one of the first and second handles and one of the second latches is a fixed half disc on the other of the first and second handles, and the rotatable collar is configured to receive the fixed disc; each of the collar and the fixed half disc is located on a stem of one of the first and second handles; each of the first and second handles includes a top, a bottom, and a side therebetween, and wherein when in the single walking support configuration, the first and second handles abut one another at their respective sides; in the single walking support configuration, the first and second shaft portions abut one another along their respective outer longitudinal sides; the handles are over-molded to cover the latching mechanism; the handle assembly includes a thumb groove sized for a user's thumb to assist with actuation of the latching mechanism and separation of the first and second handles, and the thumb groove is located in a top of the handle assembly; a bottom of each of the first and second handles has a corrugated shaped gripping surface; the gripping surface is configured to provide first and second gripping positions, the first gripping position being more forward on the first and second handles, and the second gripping position being more rearward on the first and second handles; the first and second shaft portions have magnets for abutting the first and second shaft portions together; and/or tips of the first and second shaft portions include corresponding latches configured to engage one another.

The present disclosure may also provide a two-in-one walking support that comprises first and second shaft portions, and a handle assembly that comprises a first handle that is located at the proximal end of the first shaft portion, and the first handle has a front portion, a rear portion, a top, and a bottom. The handle assembly also comprises a second handle that is located at the proximal end of the second shaft portion, and the second handle has a front portion, a rear portion, a top, and a bottom. The handle assembly further comprises a tip that is located at the distal ends of the first and second shaft portions, respectively. The rear portion of each handle is wider than the front portion and the bottom of each handle includes a generally corrugated gripping surface configured to provide first and second gripping positions by a user's fingers. The first gripping position is closer to the front portion of the first and second handles, and the second gripping position is closer to the rear portion of the first and second handles.

In one example, the walking support comprises a latching mechanism configured to releasably couple the first and second handles to form the handle assembly and a single walking support configuration wherein the first and second shaft portions abut one another along their respective longitudinal sides.

In other examples, the front portion is narrow and a middle portion between the front and rear portions is wider than the front portion; and/or each of the first and second handles has generally concave sides extending between the front and rear portions.

The present disclosure may yet further provides a method of using a two-in-one walking support that comprises the steps of holding a two-in-one walking support in a first gripping position by a user, the two-in-one walking support including first and second separable shaft portions, and each of the first and second shaft portions having a handle and a tip; actuating a latching mechanism that is incorporated into the handles of the first and second shaft portions of the two-in-one walking support to separate the handles and the first and second shaft portions of the two-in-one walking support, thereby converting a single walking support configuration of the two-in-one walking support, in which the first and second shaft portions abut one another, to a two-piece walking support configuration, in which the first and second handles are decoupled and the first and second shaft portions separated; after converting the two-in-one walking support to the two-piece walking support configuration, holding the handle of one or both of the first and second shafts portions in a second gripping position of the user, wherein the first gripping position is more forward on each handle and the second gripping position is more rearward on each handle.

In some examples, each handle has a bottom corrugated gripping surface that defines the first and second gripping positions; and/or each handle includes front, middle, and rear portions, and sides extending between the front and rear portions, the front portions are narrow and the middle portions between the front and rear portions are wider than the front portions, and the sides of each handle are generally concave.

This summary is not intended to identify essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE FIGURES

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which.

DETAILED DESCRIPTION

Figure 1A:
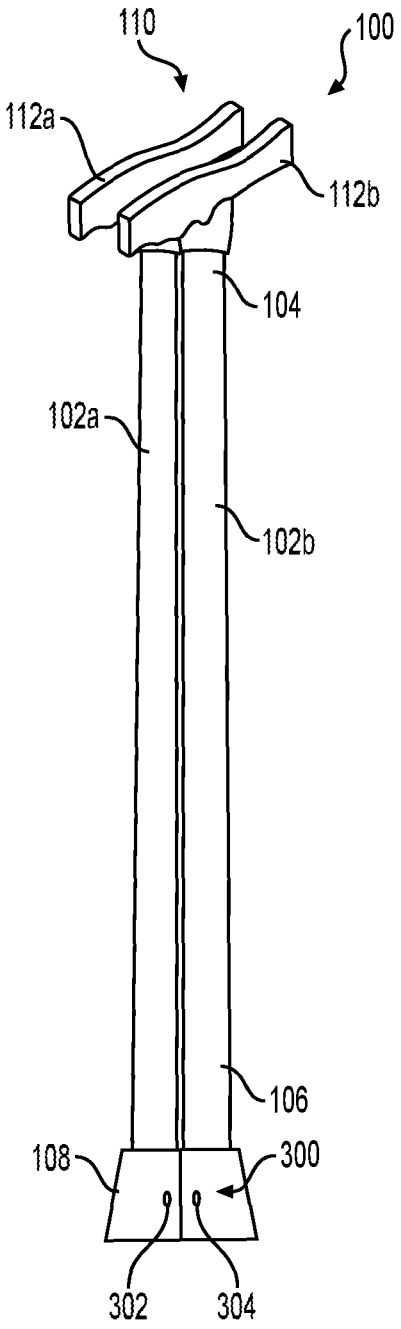
FIGS. 1*a* and 1*b* are perspective views of a walking support according to an exemplary embodiment of the present disclosure, showing the walking support in the single and two-piece configurations, respectively.

Referring to the figures, in general, the present disclosure relates to a two-in-one walking support and methods of use. The walking support can be configured to form a two-in-one cane-like structure which separates into two components or pieces, each independently usable as a walking support. The walking support of the present disclosure incorporates a latching mechanism configured to allow the user to easily latch and unlatch the two walking components to form either a singular walking support or two walking supports, as desired. Applications of the two-in-one walking support include but are not limited to, medical applications, such as for physical therapy, and geriatric applications, such as for walking assistance, recreational, such as for walking and hiking, and the like.

The separable two-in-one walking support of the present disclosure may be a unified cane-like structure formed by two longitudinally abutting shaft portions. Each shaft portion has a handle which may be latched together and unlatched from the handle of the other shaft portion. In one embodiment of the separable walking support, the cane or other structure formed from the two cane portions can be manually separable via the latching mechanism of the present disclosure into two functional walking support units. The two separated portions of the walking support can be readily reassembled via the latching mechanism into a unitary or single walking support if two independent walking supports are no longer required.

In an example, the two-in-one walking support 100 of the present disclosure comprises a first shaft portion 102*a*, a second shaft portion 102*b*, and a separable handle assembly 110. Each of the first and second shaft portions 102*a* and 102*b* has a proximal end 104 and a distal end 106. Each distal end 106 includes a tip 108 of the walking support 100. The handle assembly 110 is ergonomically shaped to provide maximum comfort to the user when using the walking support 100 in both configurations, i.e. as a single walking support and as a two-piece walking support.

Each shaft portion 102*a* and 102*b* may be an elongated, substantially straight, rectilinear structure, for example, having a substantially uniform cross section. It will be recognized that the combination of cross-sectional area and material strength of the shaft portion 102*a* and 102*b* is sufficient to support the user's weight when the walking support is being used. Each shaft portion 102*a* and 102*b* is attached at their proximal ends 104 to the bottom 126 of each handle 112*a* and 112*b*, respectively.

The handle assembly 110 includes a first handle 112*a* and a second handle 112*b* associated with the first and second shaft portions 102*a* and 102*b*, respectively. The first handle 112*a* is located at the proximal end 104 of the first shaft portion 102*a* and the second handle 112*b* is located at the proximal end 104 of the second shaft portion 102*b*.

Figure 6:
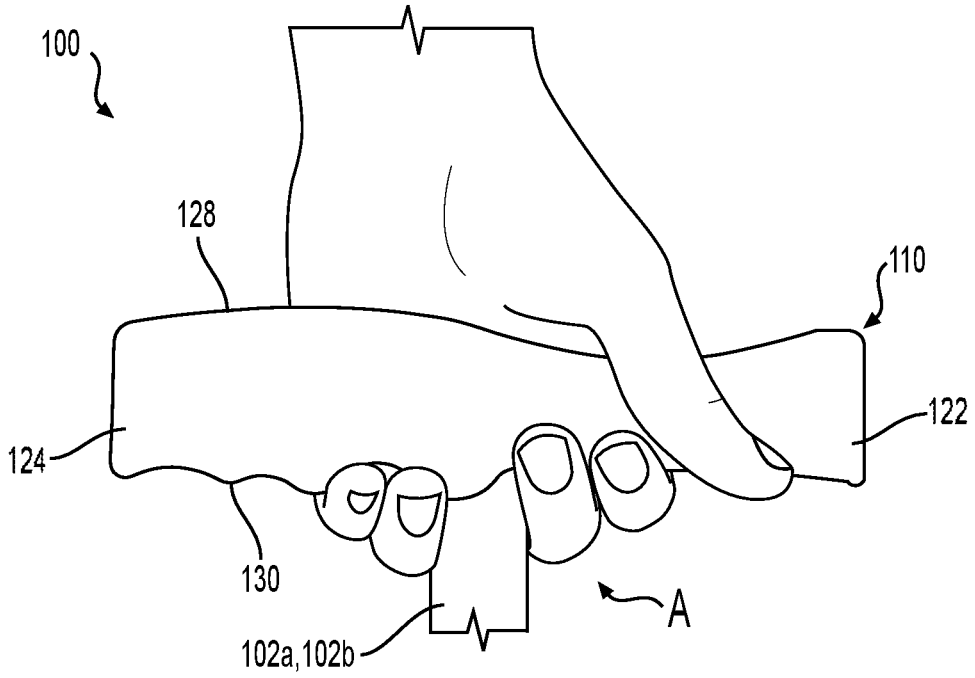
FIG. 6 is a partial side elevational view of the walking support illustrated in FIGS. 1*a* and 1*b*, showing the handle assembly being used with a first gripping configuration according to an example of the present disclosure.
Figure 7:
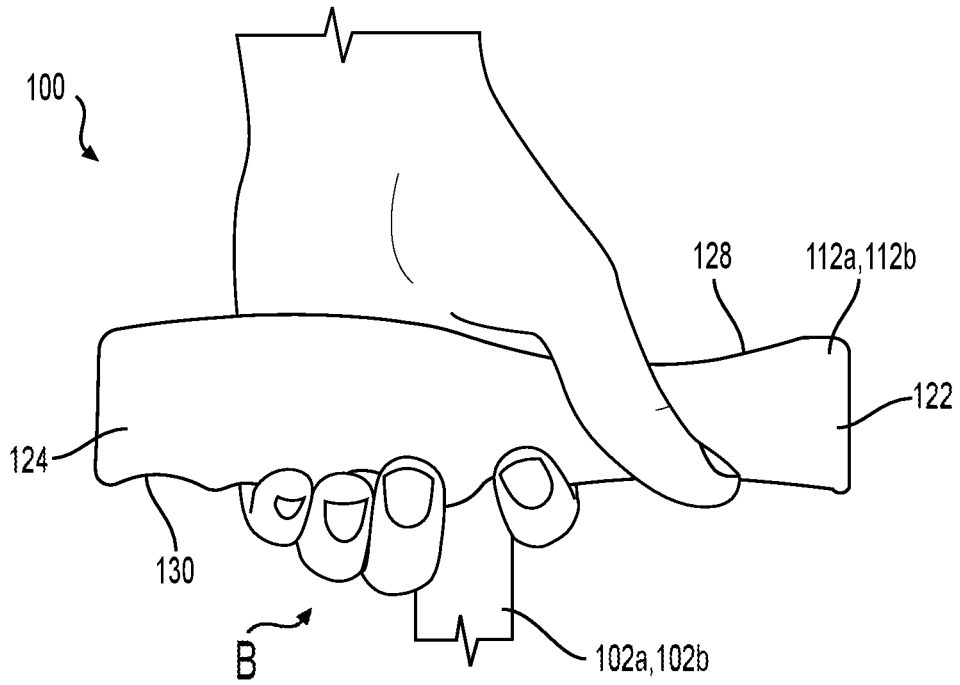
FIG. 7 is a partial side elevational view of the walking support illustrated in FIGS. 1*a* and 1*b*, showing the handle assembly being used with a second gripping configuration according to another example of the present disclosure.

The handles 112*a* and 112*b* are configured to be releasably coupled to one another via a latching mechanism 200 (FIG. 8) to form the handle assembly 110. Each handle 112*a* and 112*b* has a front 122, a back 124, a bottom 126, and a top 128. A portion of the bottom 126 of each handle 112*a* and 112*b* may have a corrugated shaped gripping surface 130 for the user's fingers. The gripping surface 130 may be shaped and designed for a dual or two position gripping, as seen in FIGS. 6 and 7 for the comfort of the user in both the single and two-piece configurations. Each tip 108 is disposed at a distal end of the shaft portions 102*a* and 102*b*, respectively. The tips 108 of the shaft portions 102*a* and 102*b* can be configured to be releasably coupled when the handles 112*a* and 112*b* are coupled.

Figure 1B:
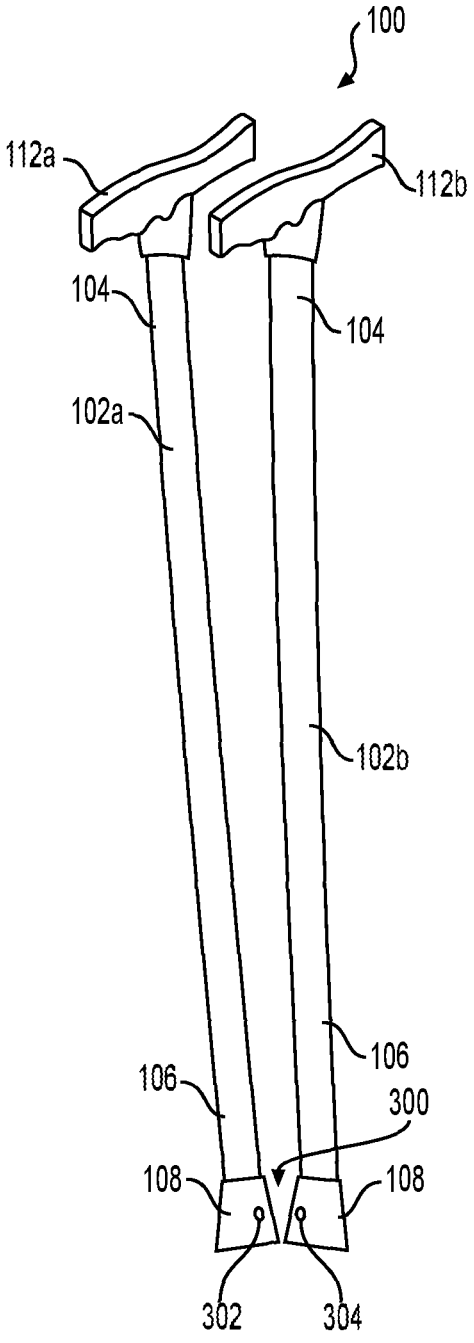

The latching mechanism 200 is incorporated into the handle assembly 110. The latching mechanism 200 is configured to allow the first and second handles 112*a* and 112*b* to be releasably coupled together to form the single walking support (FIG. 1*a*) and configured to decouple the first and second handles 112*a* and 112*b* to form the two-piece walking support (FIG. 1*b*). In an example, the handles 112*a* and 112*b* can be over-molded to cover the components of the latching mechanism 200.

Figure 2:
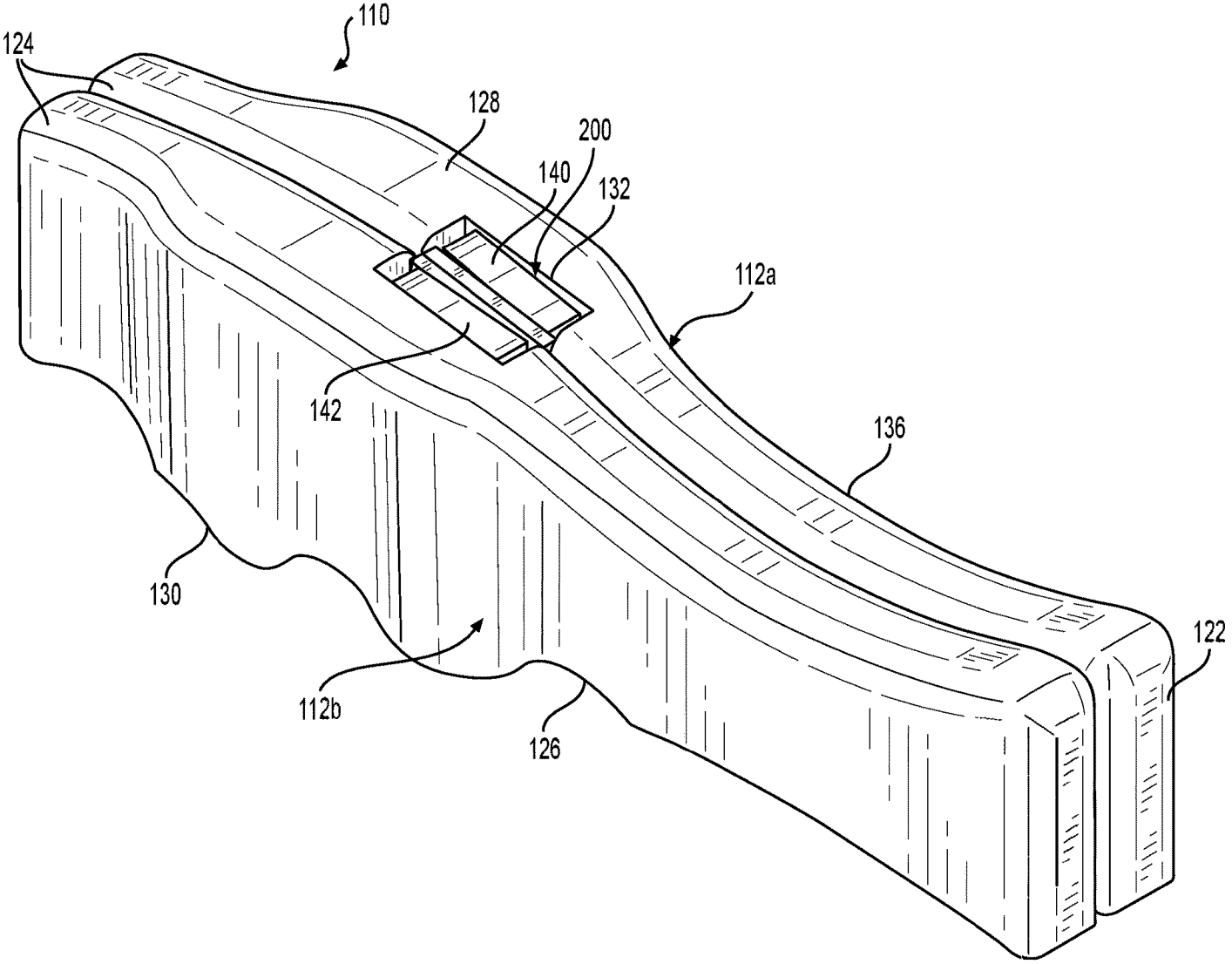
FIG. 2 is a front perspective view of a handle assembly of the walking support illustrated in FIGS. 1*a* and 1*b;*
Figure 3:
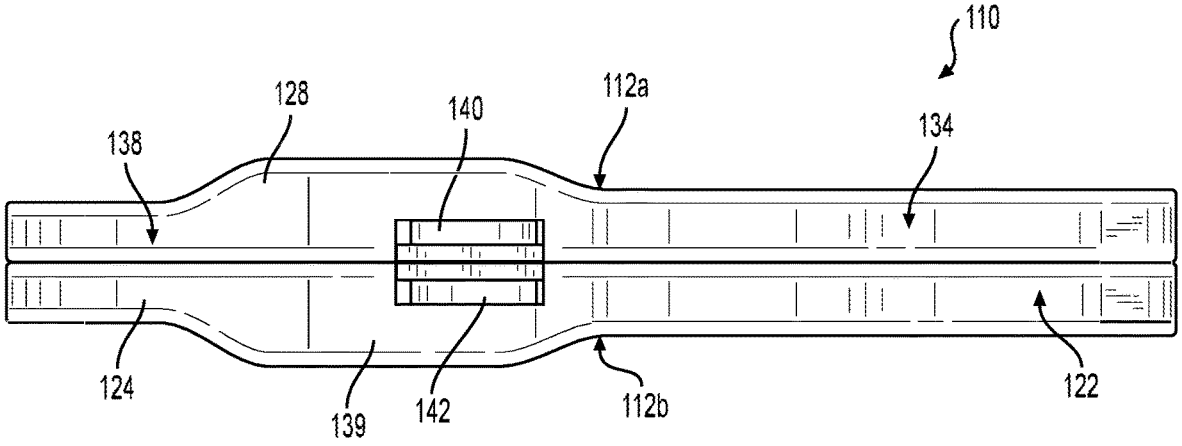
FIG. 3 is a top plan view of the handle assembly illustrated in FIG. 2.
Figure 4:
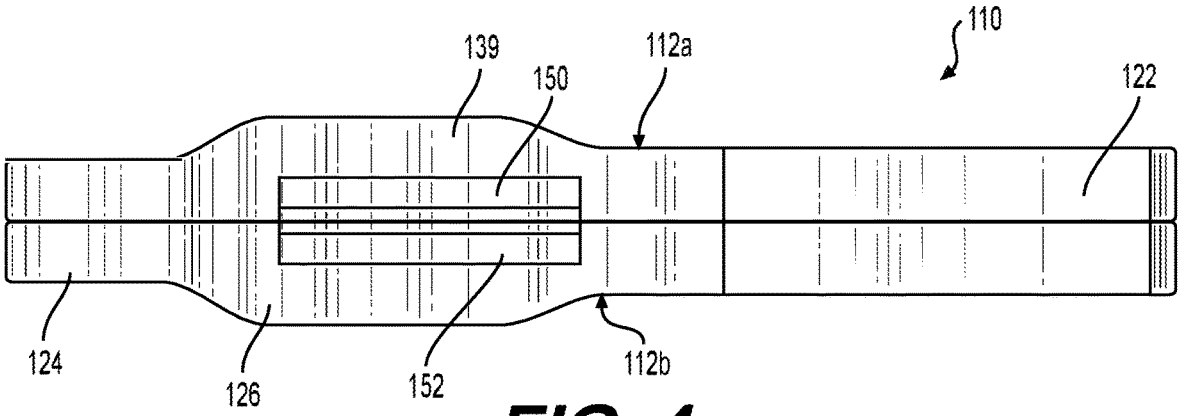
FIG. 4 is a bottom plan view of the handle assembly illustrated in FIG. 2.
Figure 5:
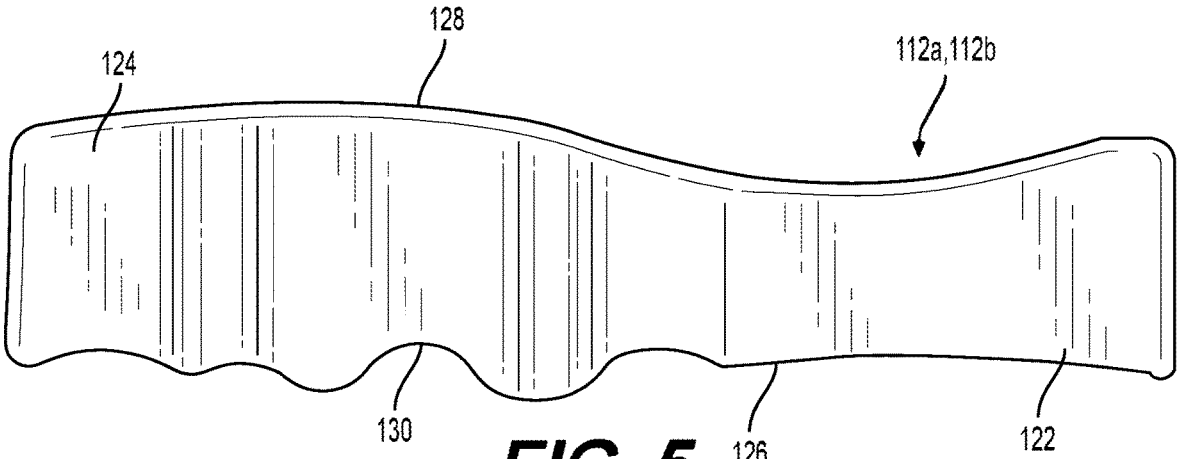
FIG. 5 is a side elevational view of the handle assembly illustrated in FIG. 2.

When handles 112*a* and 112*b* are coupled to form the handle assembly 110, a thumb groove 132 (FIG. 2) is formed that is sized for a user's thumbs to assist with actuation of the latching mechanism 200, particularly with the separation of the handles 112*a* and 112*b*. The handle assembly 110 also forms a narrow front portion 134 which has generally concave sides 136 and forms and a rear portion 138 that has a wide middle section 139, as seen in FIGS. 2-4. The wide middle section 139 is wider than the narrow front portion 134 of the handle assembly 110 to provide comfort to the user in both walking support configurations.

FIG. 6 shows the user gripping the handle assembly 110 in a first gripping position A with the user's hand being more forward on the handle assembly. This first gripping position A can be applied when using the walking support 100 as a single walking support. FIG. 7 shows the user gripping one of the handles 112*a* or 112*b* of the handle assembly 110 in a second gripping position B with the user's hand being more rearward on the handle. This second gripping position can be applied when using the walking support 100 as a two-piece walking support.

Figure 8:
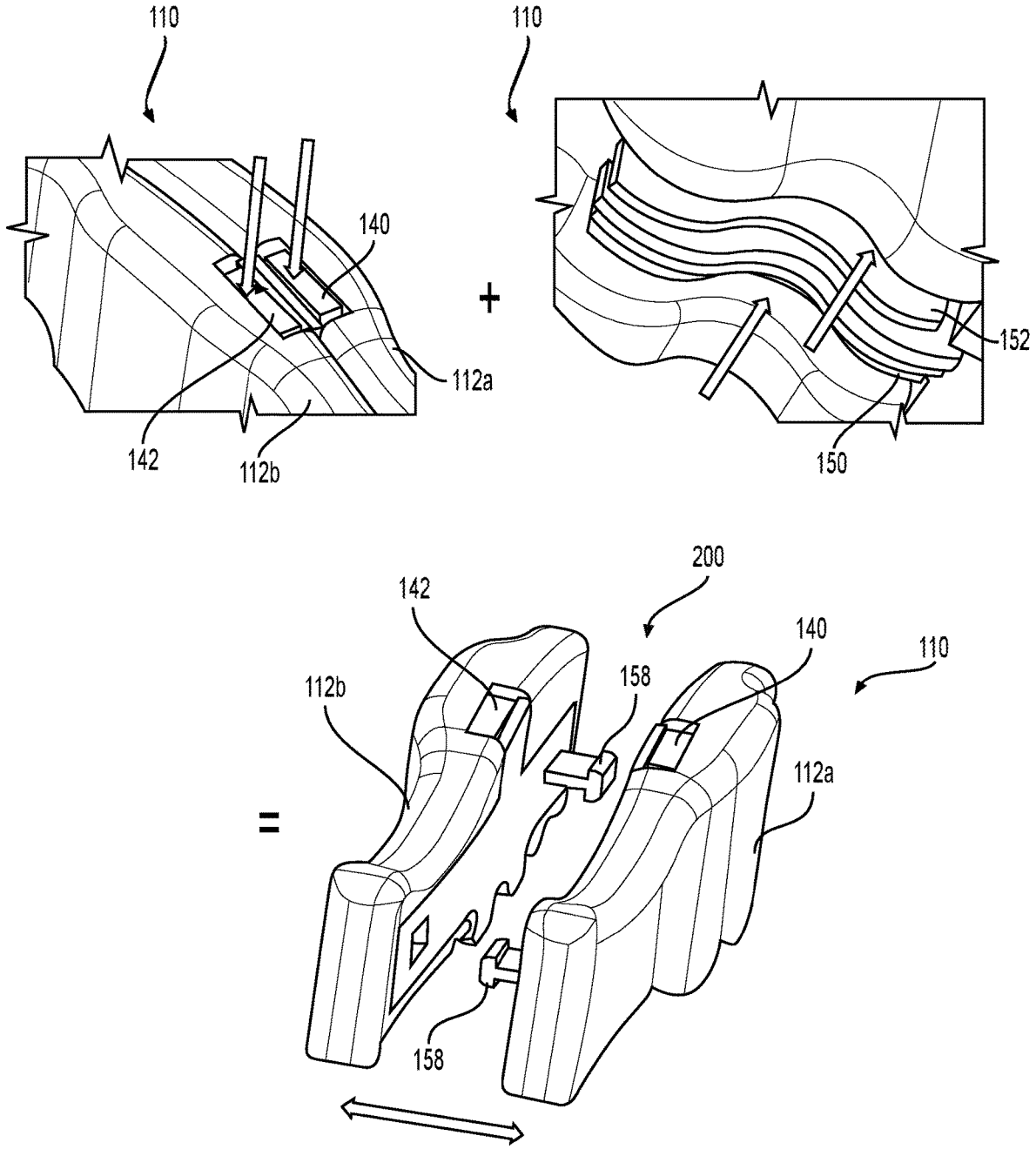
FIG. 8 illustrates a perspective view of exemplary steps for decoupling the handle assembly of the walking support illustrated in FIGS. 1*a* and 1*b;*
Figure 9:
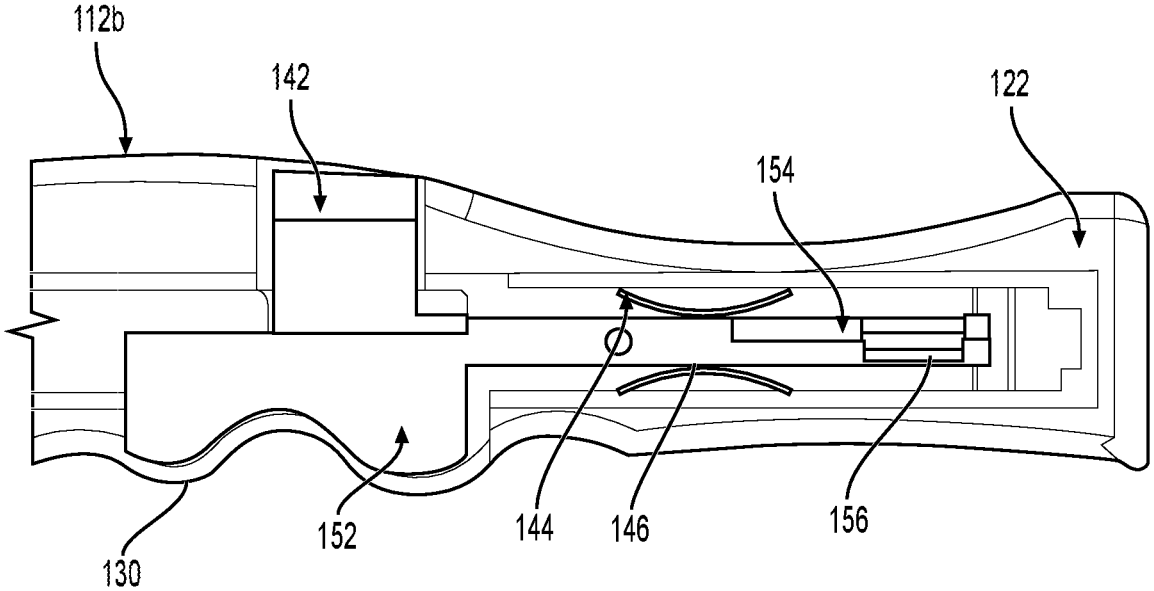
FIG. 9 is a sectional view of a handle of the handle assembly, showing the handle in a latched position.
Figure 10:
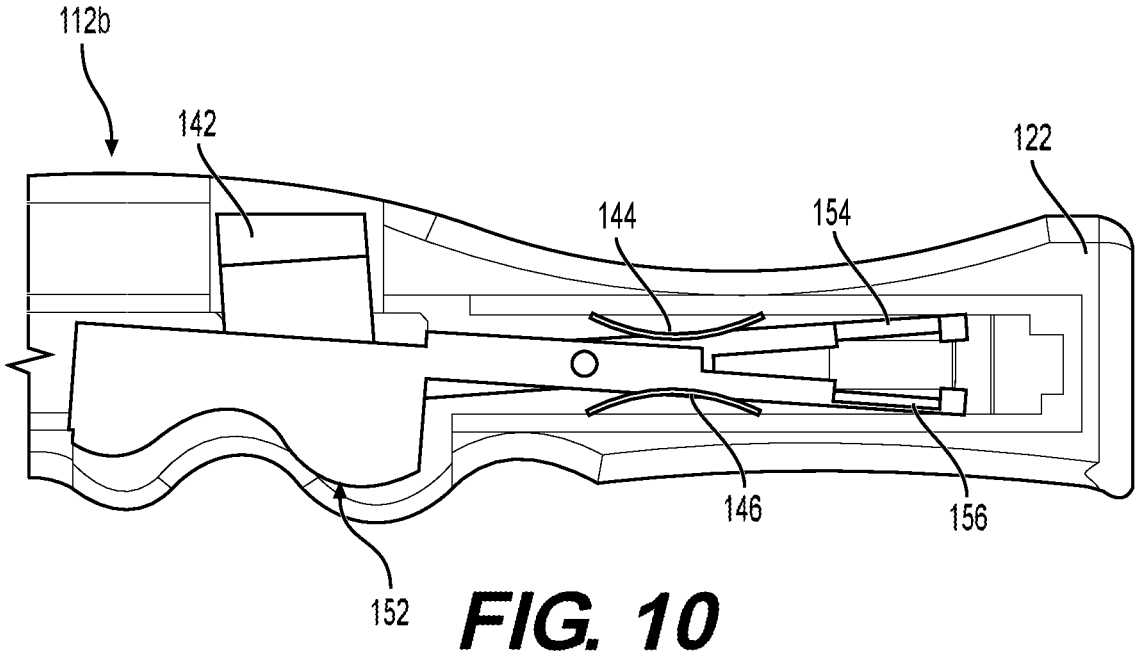
FIG. 10 is a sectional view of the handle similar to FIG. 9 but showing the handle in an unlatched position.
Figure 11:
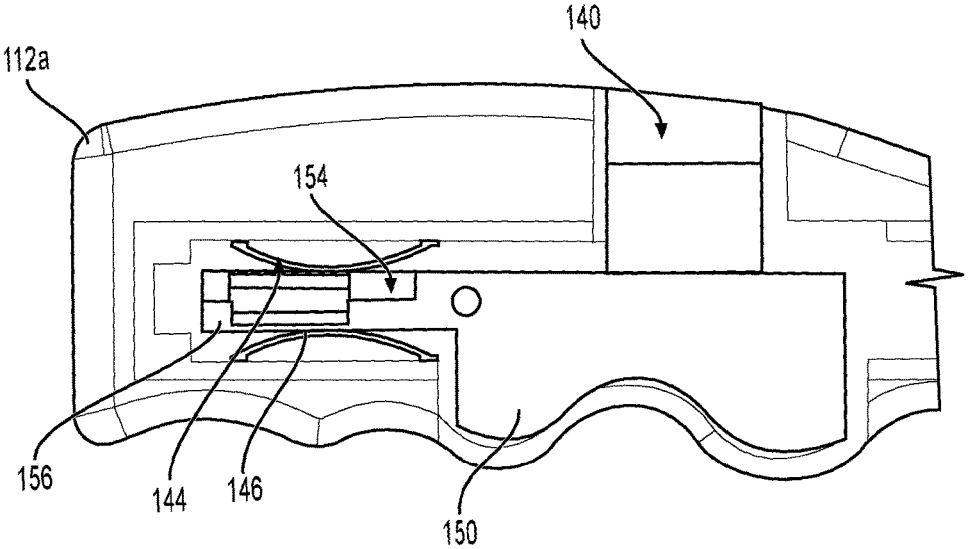
FIG. 11 is a sectional view of the other handle of the handle assembly, showing the other handle in a latched position.
Figure 12:
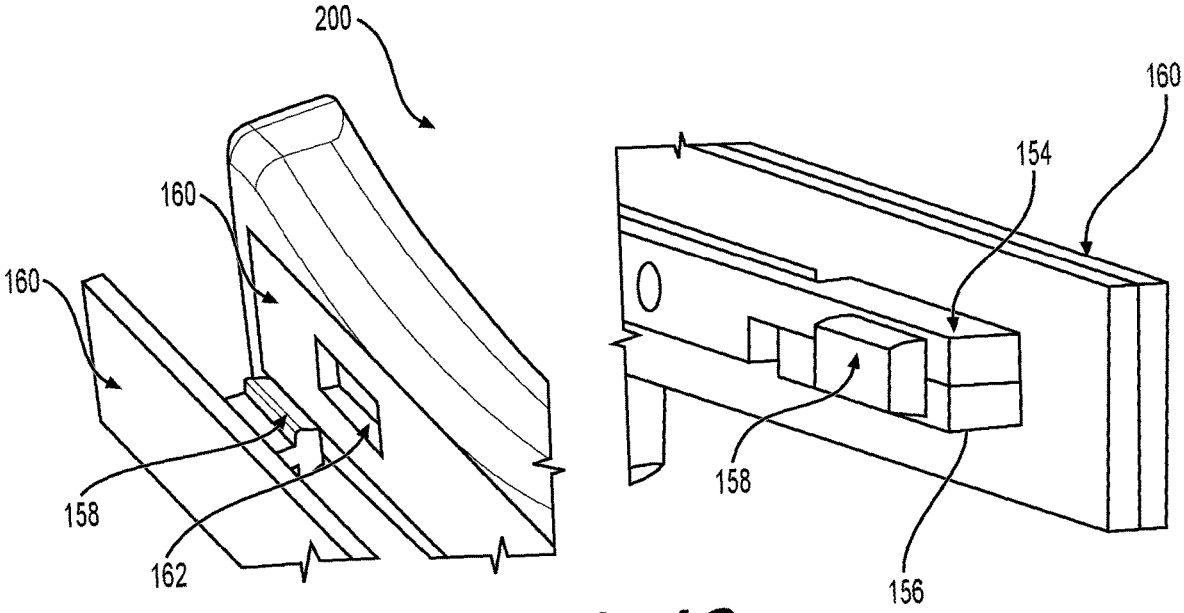
FIG. 12 is a partial perspective view of a latching mechanism in accordance with an exemplary embodiment of the present disclosure.

FIGS. 8-12 illustrate an exemplary embodiment of the latching mechanism 200 of the present disclosure and the steps for latching and unlatching the handles 112*a* and 112*b*. To convert the walking support 100 from the single cane to the two-piece cane component, the user releases the latching mechanism 200 using pinch keys 140 and 142. More specifically, the user of the walking support 100, while holding the handles 112*a* and 112*b* in their left and right hands, respectively, pinches or presses with the user's thumbs the first and second pinch keys 140 and 142 located at the tops 128 of the handles 112*a* and 112*b*, respectively, as seen in FIG. 8. The pinch keys 140 and 142 are spring biased when pressed against the bias of internal flexures or springs 144 and 146, as seen in FIGS. 9-11. The user's fingers also pull up on first and second bottom levers 150 and 152 at the bottoms 126 of the handles 112*a* and 112*b*, respectively, as seen in FIG. 8. These steps open first and second latch arms 154 and 156 in each handle, as seen in FIGS. 9-11. When the latch arms 154 and 156 open, a corresponding latch 158 projecting of each handle is released, as seen in FIG. 12, thereby disengaging the latching mechanism 200, as seen in FIGS. 9, 10, and 12. Each handle 112*a* and 112*b* may include an inner plate 160 from which the latch 158 extends, as seen in FIGS. 8 and 12. Each plate 160 can have a corresponding opening 162 for receiving the latch 158 and allowing the latch 158 to pass therethrough.

With the user's thumbs in the 132, the user can then apply force in opposite directions (away from one another) against the first and second pinch keys 140 and 142 in order to separate the first and second handles 112*a* and 112*b*, thereby separating the walking support 100 into two pieces or canes. Once the handles 112*a* and 112*b* are separated, as seen in FIG. 8, the user can release the force on the first and second bottom levers 150 and 152 and on the pinch keys 140 and 142, which allows the latching mechanism 200 to go back to its original position, due to the spring bias of flexures or springs 144 and 146 inside of the handles 112*a* and 112*b*. The user can then grip each of the handles 112*a* and 112*b* in the second gripping position B for maximum comfort. In its original position, the latching mechanism 200 is then ready for reattaching or latching the handles 112*a* and 112*b* back together when using the walking support 100 as a single walking support is needed. This is done by inserting the latches 158 into their respective openings 162 in the inner plates 160 of the handles 112*a* and 112*b*.

Figure 13:
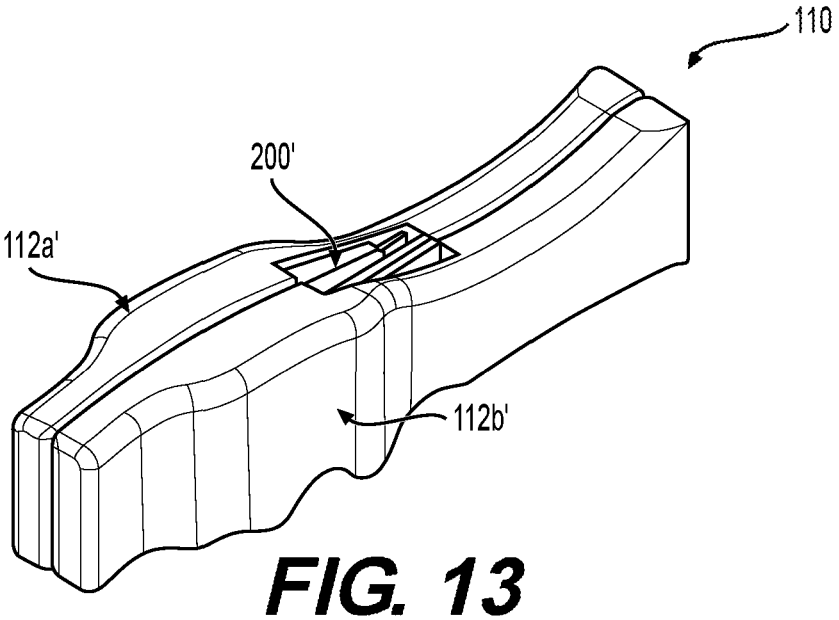
FIG. 13 is a perspective view of a handle assembly in accordance with another embodiment of the present disclosure.
Figure 14:
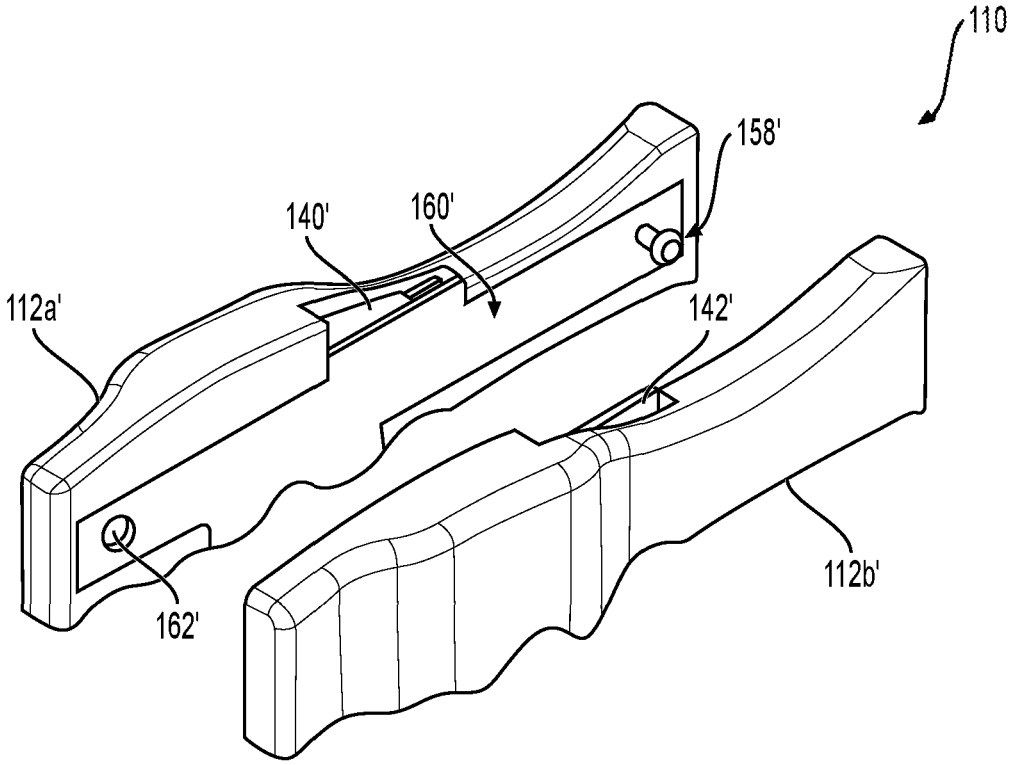
FIG. 14 is an exploded perspective view of first and second handles of the handle assembly illustrated in FIG. 13.
Figure 15:
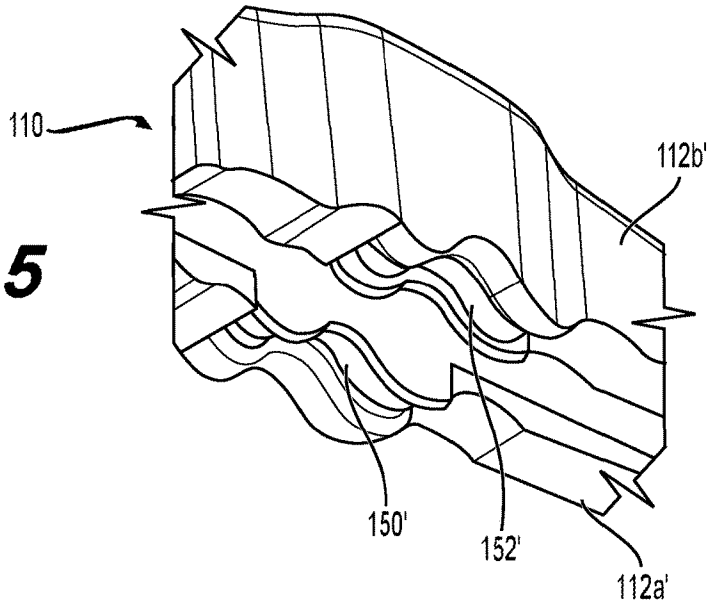
FIG. 15 is a partial bottom perspective view of the first and second handles illustrated in FIG. 14.
Figure 16:
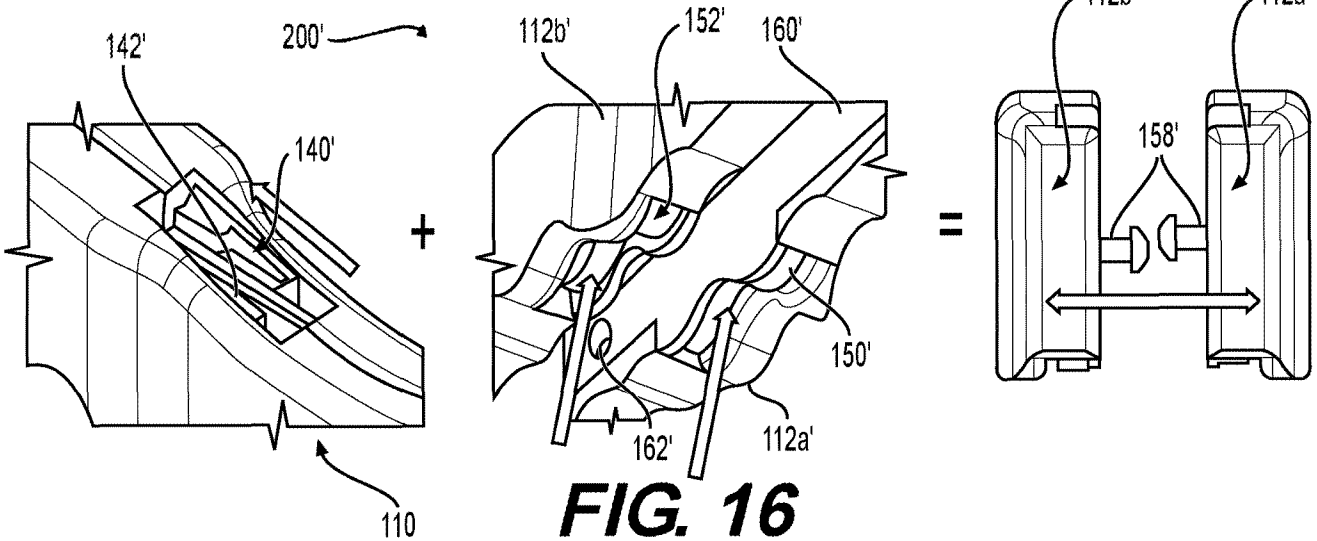
FIG. 16 illustrates a perspective view of exemplary steps for decoupling the handle assembly illustrated in FIG. 13.
Figure 17:
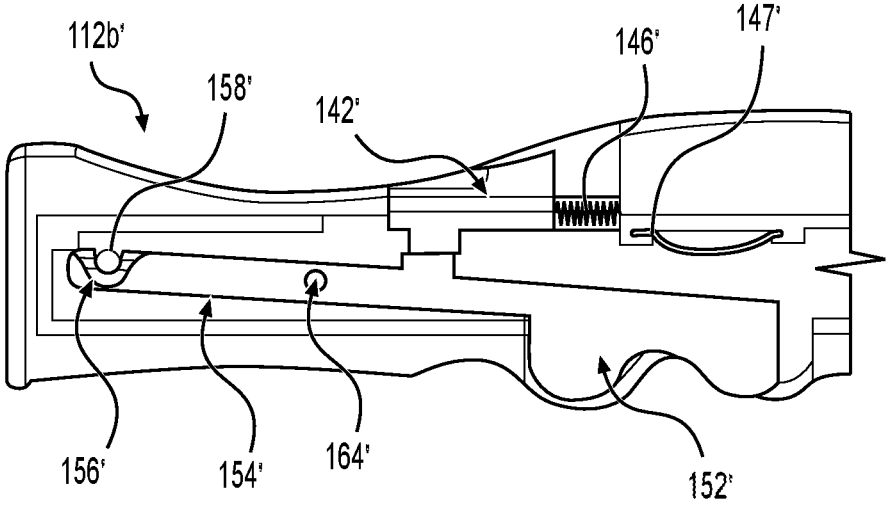
FIG. 17 is a sectional view of a handle of the handle assembly, showing the handle in a latched position.
Figure 18:
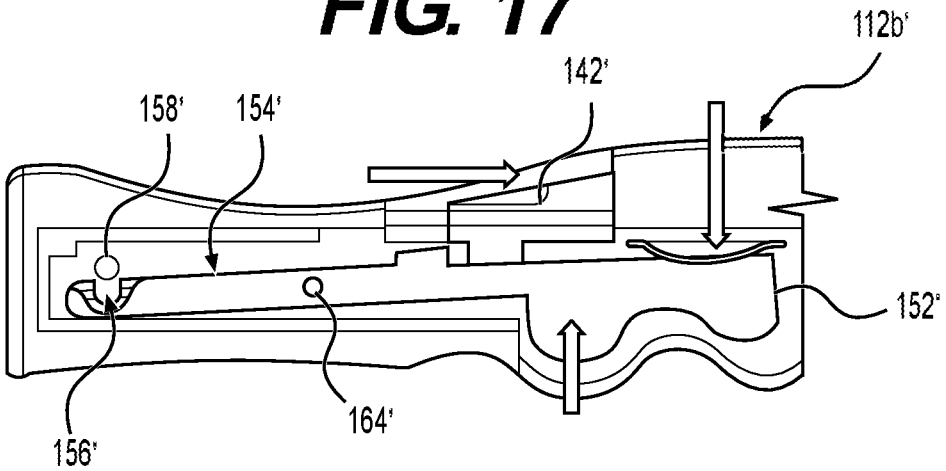
FIG. 18 is a sectional view of the handle similar to FIG. 17 but showing the handle in an unlatched position.
Figure 19:
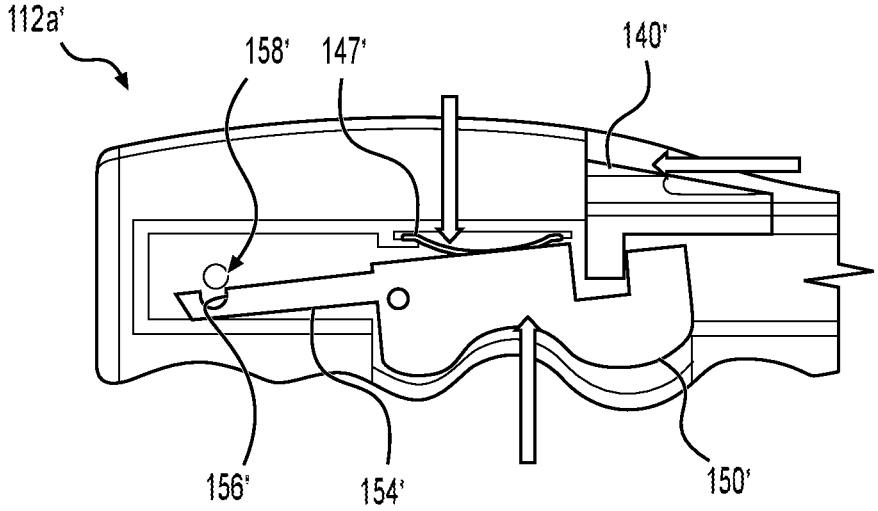
FIG. 19 is a sectional view of the other handle of the handle assembly, showing the other handle in a latched position.

FIGS. 13-19 illustrated another exemplary embodiment of a latching mechanism 200' for the handle assembly 110 of the present disclosure, which incorporates sliders instead of pinch keys. In this embodiment, to convert the walking support 100 from the single cane to the two-piece cane components, the user holds the first and second handle pieces 112*a*' and 112*b*' in both hands and pulls first and second sliders 140' and 142' of the handles 112*a*' and 112*b*', respectively, backwards, as seen in FIGS. 13 and 16. The sliders 140' and 142' can be spring biased be providing a spring 146' behind each slider, as seen in FIGS. 18 and 19.

The sliders 140' and 142' are held backwards by the user's thumbs to release respective first and second bottom levers 150' and 152' and then the levers 150' and 152' can be pulled upwards with the user's fingers, as seen in FIGS. 15 and 18. Then, using the same individual thumb, the sliders 140' and 142' can be pushed apart in opposite directions (i.e. the first slider 140' is pushed towards the left and the second slider 142' is pushed towards the right) by pinching the two sliders apart. This enables latch arms 154' inside the handles 112*a*' and 112*b*', respectively, to drop or rotate down about a fulcrum point 164' to disengage the distal end 156' of the latch arm 154' from the corresponding latch 158' projecting from the inner plates 160' of the handles, thereby allowing the handles 112*a*' and 112*b*' to separate, as seen in FIGS. 14, 16, 18 and 19. One or more spring flexures 147' can be provided above the latch arms 154' to assist with the downward force and rotation of the latch arms 154, as seen in FIG. 18. The sliders 140' and 142' are spring biased backwards to return to their original position.

The latching mechanism 200' then returns to its original position. The user can then grip each of the handles 112*a* and 112*b* in the second gripping position B. In its original position, the latching mechanism 200' is then ready for reattaching or latching the handles 112*a* and 112*b* back together when using the walking support 100 as a single walking support is needed. This is done by inserting the latches 158' into their respective openings 162' in the inner plates 160' of the handles 112*a*' and 112*b*'.

A secondary engagement 300 can be added to the shaft portions 102*a* and 102*b* of the walking support 100 to assist with converting the walking support 100 between the single and two-piece configurations. In an example, the tips 108 of the walking support 100 may include magnets 302 and 304 on each shaft portion 102*a* and 102*b*, respectively. As seen in FIGS. 1*a* and 1*b*, the magnets 302 and 304 facilitate converting the walking support 100 into the single support configuration (FIG. 1*b*) by causing the tips 108 of the shaft portions 102*a* and 102*b* to come together or abut when latching the handles 112*a* and 112*b*.

FIGS. 20*a*, 20*b*, 20*c* and FIGS. 21-25 illustrate another exemplary embodiment of the two-in-one walking support 100' that uses another exemplary latching mechanism 200". Like the walking support 100 of the embodiment above, the walking support 100' comprises a first shaft portion 102*a*', a second shaft portion 102*b*', and a separable handle assembly 110'. Each of the first and second shaft portions 102*a*' and 102*b*' has a proximal end 104' and a distal end 106'. Each distal end 106' includes a tip 108' of the walking support 100'.

Figure 21:
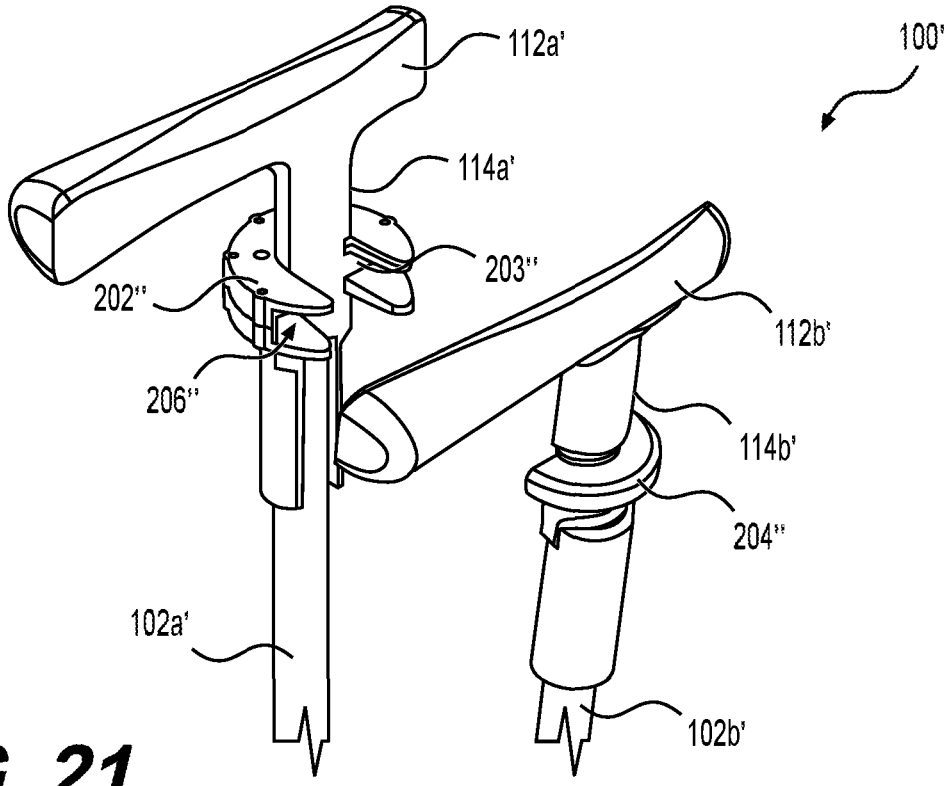
FIG. 21 is a partial perspective view of handles of the walking support illustrated in FIGS. 20*a*, 20*b*, and 20*c*, showing the handles in an open or separated configuration.
Figure 24:
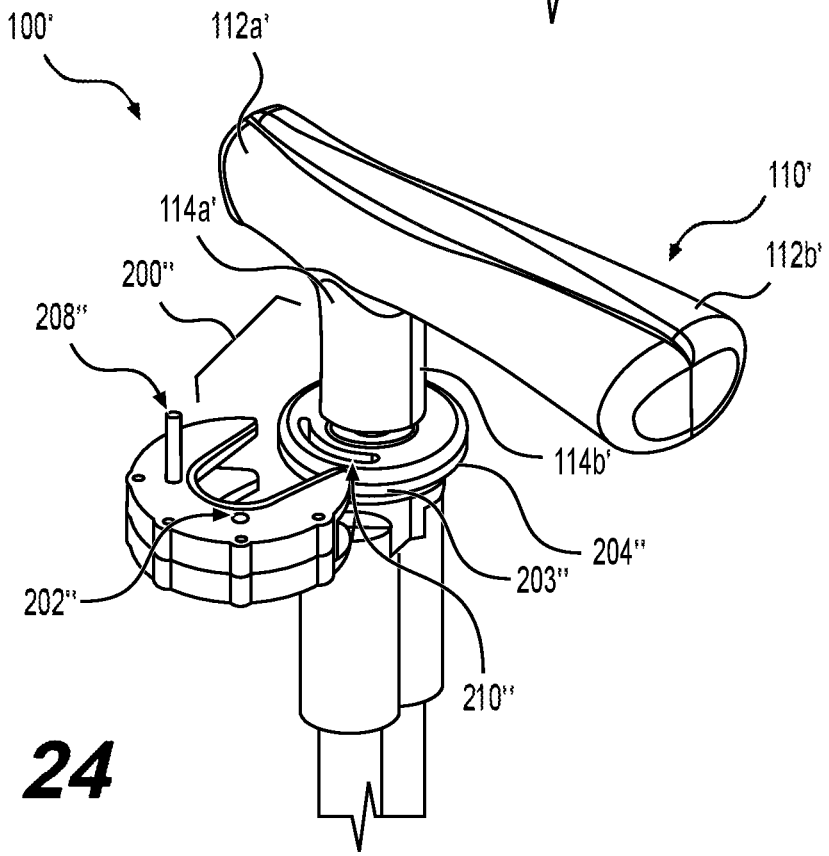
FIG. 24 is a partial exploded perspective view of the handles and latching mechanism of the walking support illustrated in FIGS. 20*a*, 20*b*, and 20*c;*

The handle assembly 110' includes a first handle 112*a*' and a second handle 112*b*' associated with the first and second shaft portions 102*a*' and 102*b*', respectively. The handles 112*a*' and 112*b*' are configured to be releasably coupled to one another via the latching mechanism 200" to form the handle assembly 110'. The latching mechanism 200" can be a collar mechanism incorporated into the stems 114*a*' and 114*b* of the handles 112*a*' and 112*b*', respectively. In particular, the stem 114*a*' of the first handle 112*a*' includes a rotating collar 202" and a first half disc 203" of the latching mechanism 200" and the stem 114*b*' of the second handle 112*b*' includes a fixed second half disc 204" that cooperates with the collar 202" and first half disc 203" for latching and unlatching the handles 112*a*' and 112*b*'. The collar 202" is coupled to the first half disc 203" that is on the stem 114*a*' of the first handle 112*a*'. The collar 202" is coupled to the first half disc 203" via a pin member 208" that is received in a curved slot 210" in the first half disc 203", as seen in FIG. 24, such that the collar 202" can rotate around and over the second half disc 204". The location of the pin member 208" with respect to the collar 202" can vary and allows for clockwise or counterclockwise rotation of collar 202" with respect to the stem 114*a*'. The collar 202" includes an inner channel 206" sized and shaped to receive the second half disc 204" when the handles 112*a*' and 112*b*' are latched together, as seen in FIGS. 21 and 22.

Figures 20A, 20B, 20C:
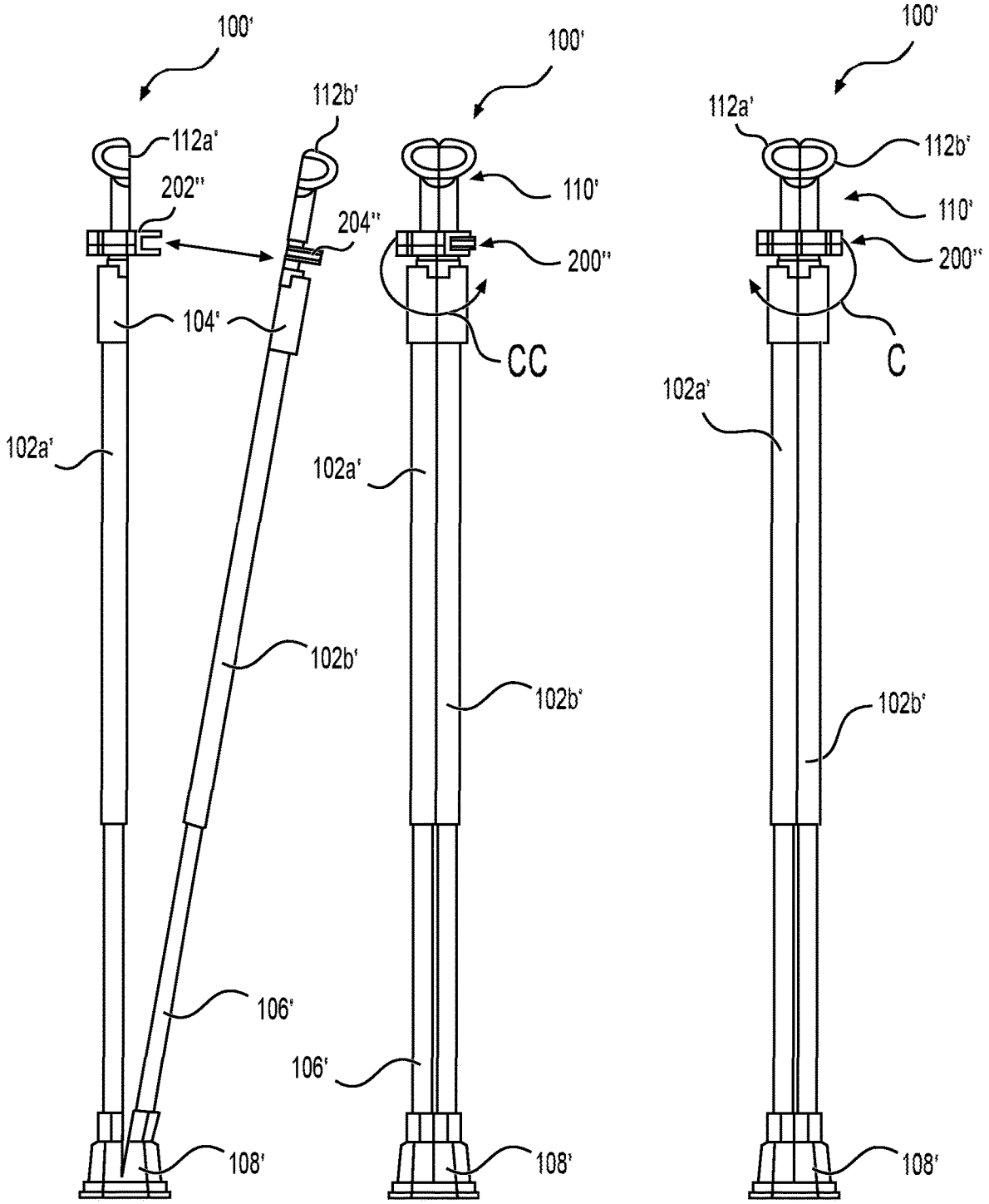
FIGS. 20*a*, 20*b*, and 20*c* are elevational views of a walking support according to another exemplary embodiment of the present disclosure, showing the walking support being open and closed between the single and two-piece configurations, respectively.

FIGS. 20*a*, 20*b*, and 20*c* illustrate the walking support 100' showing the walking support 100' being open and closed between the single and two-piece configurations. FIG. 21 shows the handles 112*a* and 112*b* of the handle assembly 110' in an open or separated configuration. FIG. 22 shows the handles 112*a* and 112*b* assembled and latched together. To assemble the handles 112*a*' and 112*b*' and close or abut the shaft portions 102*a*' and 102*b*' together to form the single configuration of the walking support 100', the user aligns the tips or feet 108' of the shaft portions 102*a*' and 102*b*' and draws the shaft portions 102*a*' and 102*b*' toward one another, as seen in FIG. 20*a*. With the collar 202" in its open position (FIG. 21), the user then rotates the collar 202" in a first direction (e.g. a counterclockwise direction CC), by rotating the collar 202" by 90 degrees, for example, around the stems 114*a*' and 114*b*' until it engages the second half disc 204" of the second handle 112*b*'.

Figure 26A:
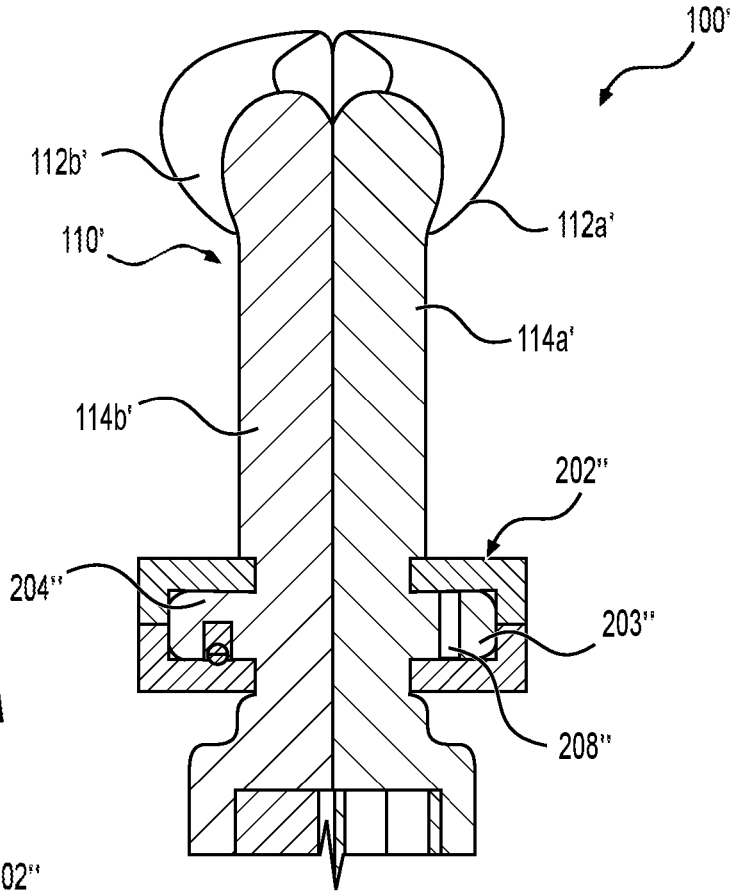
FIGS. 26*a* and 26*b* are partial and enlarged sectional views of the handles of the walking support illustrated in FIGS. 20*a*, 20*b*, and 20*c*, showing engagement features of the latching mechanism.
Figure 26B:
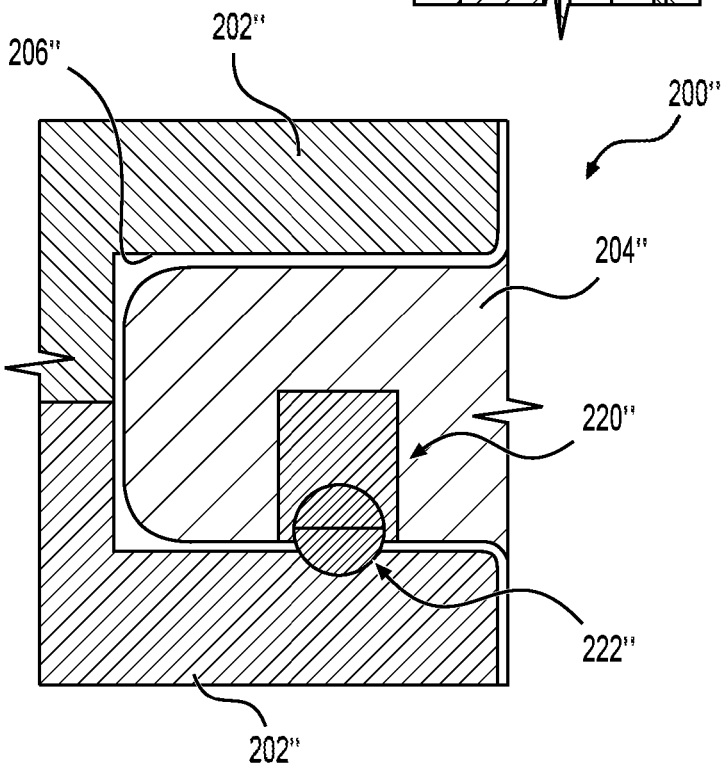

As seen in FIGS. 26*a* and 26*b*, engagement features can be provided on the collar 202" and the second half disc 204" to assist with latching them together. In an example, the engagement features may form a snap engagement, such as by using a fixed ball nose spring plunger 220" and corresponding detent 222". The fixed ball nose plunger 220" can be located in the second half disc 204" and the detent 222" located on the collar 202", as best seen in FIGS. 26*a* and 26*b*. The detent 222" is sized to accept the ball nose spring plunger 220" when the user rotates the collar 202" into the fully open or fully closed positions. When the collar 202" is placed in the fully open or closed position, the ball nose spring plunger 220" will latch the collar 202" into place so it remains stationary while the walking support 100' is in use.

Figure 22:
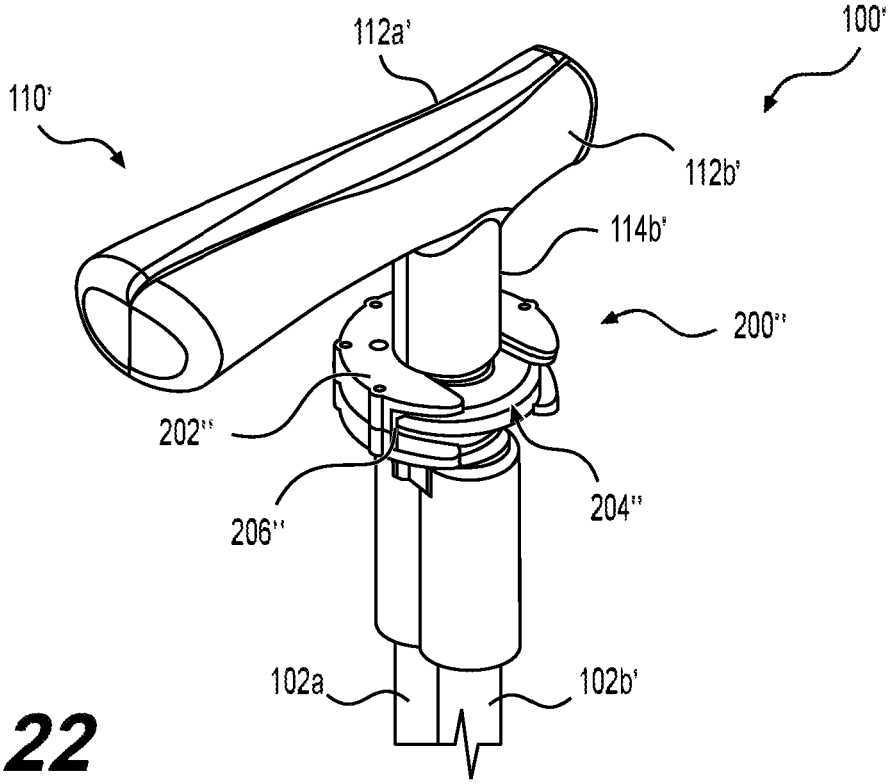
FIG. 22 is a partial perspective view of the handles of the walking support illustrated in FIG. 21, showing the handles assembled with a latching mechanism in an open unlatched position.
Figure 23:
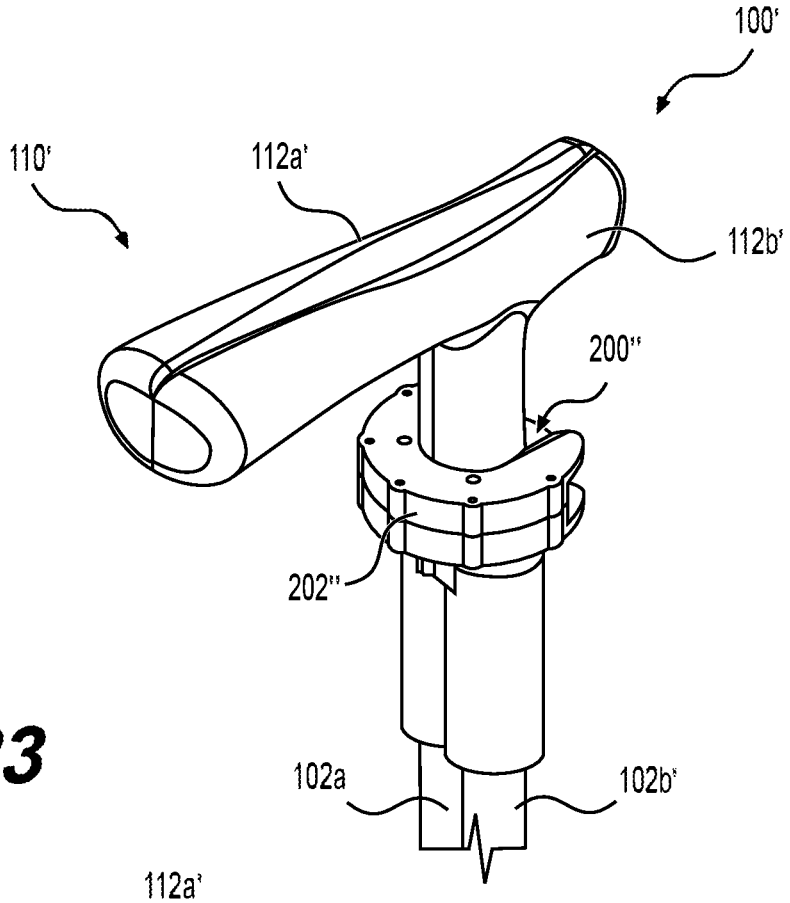
FIG. 23 is a partial perspective view of the handles similar to FIG. 22, showing the latching mechanism in a closed latched position.

The collar 202" rides over the second half disc 204" of the second handle 102*b*' such that the second half disc 204" is received in the channel 206" of the collar 202" as the collar 202" rotates to latch the handles 112*a*' and 112*b*' together and such that the shaft portions 102*a*' and 102*b*' abut one another, as seen in FIGS. 20*b* and 22. The channel 206" of the collar 202" is configured to allow for misalignment of the mating handle 112*b*' by drawing in the second half disc 204' into correct alignment when received in the channel 206". Once latched, the walking support 100' is in the single walking support configuration and can be used as such.

Figure 25:
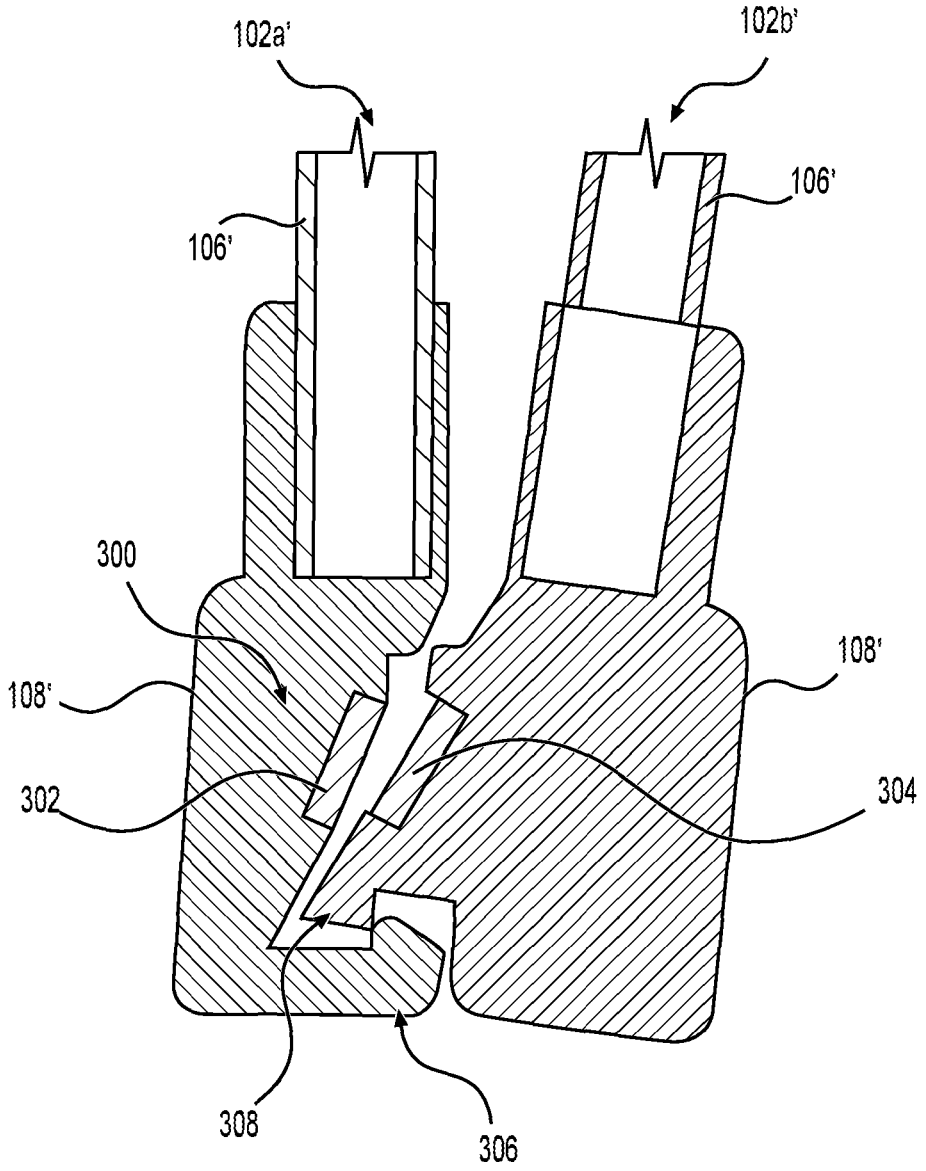
FIG. 25 is a partial sectional view of the distal end of the walking support illustrated in FIGS. 20*a*, 20*b*, and 20*c*.

As seen in FIG. 25, the tips 108' of the shaft portions 102*a*' and 102*b*' can include the secondary engagement 300, include magnets 302 and 304. The tips 108' may also have corresponding latches 306 and 308 that are configured to engage one another and tighten as the shaft portions 102*a*' and 102*b*' come together.

To convert the walking support 100' to the two-piece configuration and open the handles 112*a*' and 112*b*', the collar 202" is rotated in a second opposite direction (e.g. clockwise), as seen in FIG. 20*c*, until the collar 202" is disengage and released from the fixed second half disc 204". The handles 112*a*' and 112*b*' can then be separated along with the shaft portions 102*a*' and 102*b*. Once separated, the walking support 100' is in the two-piece configuration as can be used as such.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms, such as right, left, above, below, upper, lower, top, bottom, linear, arcuate, elongated, parallel, perpendicular, etc. These terms are not intended to limit the disclosure and, in general, are used for convenience to facilitate the description based on the examples shown in the figures. In addition, the geometric or relational terms may not be exact. For instance, walls may not be exactly perpendicular or parallel to one another because of, for example, roughness of surfaces, tolerances allowed in manufacturing, etc., but may still be considered to be perpendicular or parallel.

What is claimed is:

1. A two-in-one walking support, comprising:

first and second shaft portions;

a handle assembly, comprising, a first handle that is located at a most proximal end of the first shaft portion;

a second handle that is located at a most proximal end of the second shaft portion; and a latching mechanism incorporated into the first and second handles, the latching mechanism being configured to releasably couple the first and second handles to form the handle assembly and a single walking support configuration with the first and second shaft potions abutting one another and being configured to decouple the first and second handles and separate the first and second shaft portions to form a two-piece walking support configuration, wherein the latching mechanism includes a plurality of cooperating first and second latches, the first handle includes at least one of the first latches and at least one of the second latches, and the second handle includes at least one of the first latches and at least one of the second latches, and wherein one of the first latches on one of the first and second handles is a rotatable collar that is configured to receive one of the second latches on the other of the first and second handles.

2. The walking support of claim 1, wherein the first latches are spring biased pinch keys or sliders and the second latches are levers.

3. The walking support of claim 1, wherein the first latches are spring biased latch arms and the second latches are projecting latches.

4. The walking support of claim 1, wherein the one of the second latches is a fixed half disc on the other of the first and second handles, and the rotatable collar is configured to receive the fixed half disc.

5. The walking support of claim 4, wherein each of the collar and the fixed half disc is located on a stem of one of the first and second handles.

6. The walking support of claim 1, wherein each of the first and second handles includes a top, a bottom, and a side therebetween, and wherein when in the single walking support configuration, the first and second handles abut one another at their respective sides.

7. The walking support of claim 1, wherein in the single walking support configuration, the first and second shaft portions abut one another along their respective outer longitudinal sides.

8. The walking support of claim 1, wherein the handles are over-molded to cover the latching mechanism.

9. The walking support of claim 1, wherein the handle assembly includes a thumb groove sized for a user's thumb to assist with actuation of the latching mechanism and separation of the first and second handles, and the thumb groove is located in a top of the handle assembly.

10. The walking support of claim 1, wherein a bottom of each of the first and second handles has a corrugated shaped gripping surface.

11. The walking support of claim 10, wherein the gripping surface is configured to provide first and second gripping positions, the first gripping position being more forward on the first and second handles, and the second gripping position being more rearward on the first and second handles.

12. The walking support of claim 1, wherein the first and second shaft portions have magnets for abutting the first and second shaft portions together.

13. The walking support of claim 1, wherein tips of the first and second shaft portions include corresponding latches configured to engage one another.

14. A two-in-one walking support, comprising:

first and second shaft portions;

a handle assembly comprising, a first handle that is located at the proximal end of the first shaft portion, and the first handle having a front portion, a rear portion, a top, and a bottom;

a second handle that is located at the proximal end of the second shaft portion, and the second handle having a front portion, a rear portion, a top, and a bottom;

a tip being located at the distal ends of the first and second shaft portions, respectively; and a latching mechanism configured to releasably couple the first and second handles to form the handle assembly and a single walking support configuration wherein the first and second shaft potions abut one another along their respective longitudinal sides, and wherein the latching mechanism includes a rotatable collar, wherein the rear portion of each handle is wider than the front portion and the bottom of each handle includes a generally corrugated gripping surface configured to provide first and second gripping positions by a user's fingers, the first gripping position being closer to the front portion of the first and second handles, and the second gripping position being closer to the rear portion of the first and second handles.

15. The walking support of claim 14, wherein the front portion is narrow and a middle portion between the front and rear portions is wider than the front portion.

16. The walking support of claim 15, wherein each of the first and second handles has generally concave sides extending between the front and rear portions.

17. A method of using a two-in-one walking support, comprising the steps of:

holding a two-in-one walking support in a first gripping position by a user, the two-in-one walking support including first and second separable shaft portions, and each of the first and second shaft portions having a handle and a tip;

actuating a latching mechanism that is incorporated into the handles of the first and second shaft portions of the two-in-one walking support to separate the handles and the first and second shaft portions of the two-in-one walking support, thereby converting a single walking support configuration of the two-in-one walking support, in which the first and second shaft potions abut one another, to a two-piece walking support configuration, in which the first and second handles are decoupled and the first and second shaft portions separated;

after converting the two-in-one walking support to the two-piece walking support configuration, holding the handle of one or both of the first and second shafts portions in a second gripping position of the user, wherein the first gripping position is more forward on each handle and the second gripping position is more rearward on each handle.

18. The method of claim 17, wherein each handle has a bottom corrugated gripping surface that defines the first and second gripping positions.

19. The method of claim 17, wherein each handle includes front, middle, and rear portions, and sides extending between the front and rear portions, the front portions are narrow and the middle portions between the front and rear portions are wider than the front portions, and the sides of each handle are generally concave.

* * * * *